US008119984B2

(12) United States Patent
Shabanowitz et al.

(10) Patent No.: US 8,119,984 B2
(45) Date of Patent: Feb. 21, 2012

(54) METHOD AND APPARATUS FOR GENERATION OF REAGENT IONS IN A MASS SPECTROMETER

(75) Inventors: Jeffrey Shabanowitz, Charlottesville, VA (US); Philip D. Compton, Charlottesville, VA (US); Lee Earley, Mountain View, CA (US); George C. Stafford, Jr., San Jose, CA (US); Donald F. Hunt, Charlottesville, VA (US); Christopher Mullen, Menlo Park, CA (US)

(73) Assignees: University of Virginia Patent Foundation, Charlottesville, VA (US); Thermo Finnigan LLC, San Jose, CA (US)

( * ) Notice: Subject to any disclaimer, the term of this patent is extended or adjusted under 35 U.S.C. 154(b) by 170 days.

(21) Appl. No.: 12/473,570

(22) Filed: May 28, 2009

(65) Prior Publication Data

US 2009/0294649 A1 Dec. 3, 2009

Related U.S. Application Data

(60) Provisional application No. 61/057,751, filed on May 30, 2008.

(51) Int. Cl.
*H01J 49/10* (2006.01)

(52) U.S. Cl. ..... 250/288; 250/423 R

(58) Field of Classification Search ..... 250/282, 250/288, 423 R–423 F

See application file for complete search history.

(56) References Cited

U.S. PATENT DOCUMENTS

| | | | | |
|---|---|---|---|---|
| 4,159,423 | A * | 6/1979 | Kambara | 250/423 R |
| 7,026,613 | B2 | 4/2006 | Syka | |
| 2002/0121596 | A1 | 9/2002 | Laiko et al. | |
| 2004/0173740 | A1 | 9/2004 | McLuckey | |
| 2005/0092915 | A1 * | 5/2005 | Fukano et al. | 250/288 |
| 2005/0199804 | A1 * | 9/2005 | Hunt et al. | 250/290 |
| 2005/0279931 | A1 * | 12/2005 | Franzen et al. | 250/290 |
| 2006/0022132 | A1 * | 2/2006 | Zhang | 250/290 |
| 2006/0054806 | A1 * | 3/2006 | Yamada et al. | 250/288 |
| 2007/0057172 | A1 | 3/2007 | Wang | |
| 2008/0073502 | A1 * | 3/2008 | Schneider et al. | 250/282 |
| 2009/0127453 | A1 * | 5/2009 | Ding et al. | 250/282 |

FOREIGN PATENT DOCUMENTS

| | | | |
|---|---|---|---|
| WO | WO 2006/042187 | A2 | 4/2006 |
| WO | WO 2006/129068 | A2 | 12/2006 |

OTHER PUBLICATIONS

Wells, et al., ""Dueling"ESI: Instrumentation to Study Ion/Ion Reactions of Electrospray-Generated Cations and Anions," J Am Soc Mass Spectrom, vol. 13 (6), pp. 614-622, (2002). Liang et al., "Transmission Mode Ion/Ion Proton Transfer Reactions in a Linear Ion Trap," J Am Soc Mass Spectrom , vol. 18, pp. 882-890, (2007).

Han et al., "Beam-type Collisional Activation of Polypeptide Cations that Survive Ion/Ion Electron Transfer," Rapid Commun. Mass Spectrom., vol. 21, pp. 1567-1573, (2007).

Liang et al., "Transmission Mode Ion/Ion Electron-Transfer Dissociation in a Linear Ion Trap," Anal. Chem. , vol. 79, pp. 3363-3370, (2007).

* cited by examiner

*Primary Examiner* — Jack Berman
*Assistant Examiner* — David E Smith
(74) *Attorney, Agent, or Firm* — Charles B. Katz

(57) ABSTRACT

A front-end reagent ion source for a mass spectrometer is disclosed. Reagent vapor is supplied to a reagent ionization volume located within a chamber of the mass spectrometer and maintained at a low vacuum pressure. Reagent ions are formed by interaction of the reagent vapor molecules with an electrical discharge (e.g., a glow discharge) within the ionization volume, and pass into the chamber of the mass spectrometer. At least one ion optical element located along the analyte ion path transports the reagent ions to successive chambers of the mass spectrometer. The reagent ions may be combined with the analyte ions to perform ion-ion studies such as electron transfer dissociation (ETD).

29 Claims, 6 Drawing Sheets

METHOD AND APPARATUS FOR GENERATION OF REAGENT IONS IN A MASS SPECTROMETER

CROSS REFERENCE TO RELATED APPLICATION

This application claims the priority benefit under 35 U.S.C. §119(e)(1) of U.S. provisional patent application Ser. No. 61/057,751 by Earley et al., entitled "Method and Apparatus for Generation of Reagent Ions in a Mass Spectrometer", the disclosure of which is incorporated herein by reference.

FIELD OF THE INVENTION

The present invention relates generally to ion sources for mass spectrometry, and more particularly to an ion source for generating reagent ions for electron transfer dissociation or other ion-ion reaction experiments.

BACKGROUND OF THE INVENTION

Mass spectrometry has been extensively employed for ion-ion chemistry experiments, in which analyte ions produced from a sample are reacted with reagent ions of opposite polarity. McLuckey et al. ("Ion/Ion Chemistry of High-Mass Multiply Charged Ions, *Mass Spectrometry Reviews*, Vol. 17, pp. 369-407(1998)) discusses various examples of mass spectrometric studies of this type. It has been recently discovered that by selecting an appropriate reagent anion and reacting the reagent anion with a multiply charged analyte cation, a radical site is generated that induces dissociation of the analyte cation into product ions. This process, called electron transfer dissociation (ETD), is described by Hunt et al. in U.S. Pat. No. 7,534,622 for "Electron Transfer Dissociation for Biopolymer Sequence Mass Spectrometric Analysis", as well as by Syka et al. in "Peptide and Protein Sequence Analysis by Electron Transfer Dissociation Mass Spectrometry", *Proc. Nat. Acad. Sci.*, vol. 101, no. 26, pp. 9528-9533(2004), both of which are incorporated herein by reference. ETD is a particularly useful tool for proteomics research, since it yields information complementary to that obtained by conventional dissociation techniques (e.g., collisionally induced dissociation), and also because ETD tends to generate product ions having intact post-translational modifications.

Implementation of ETD or other ion-ion experiments in a mass spectrometer requires two ion sources: a first ion source for generating analyte ions from a sample, and a second ion source for generating reagent ions. Typically, the analyte ion source utilizes an ionization technique, such as electrospray ionization, that operates at atmospheric pressure. Atmospheric or near-atmospheric pressure ionization techniques have also been employed or proposed for production of reagent ions (see, e.g., Wells et al. "'Dueling' ESI: Instrumentation to Study Ion/Ion Reactions of Electrospray-Generated Cations and Anions", *J. Am. Soc. Mass Spectrometry*, vol. 13, pp. 614-622(2002), and U.S. Patent Application Publication No. 2008/0245963 by Land et al. entitled "Method and Apparatus for Generation of Reagent Ions in a Mass Spectrometer"). However, it has been found that atmospheric-pressure ionization techniques may not be well-suited to production of certain labile ETD reagent ion species, which tend to be neutralized within the environment of an atmospheric-pressure ionization chamber via loss of electrons to background gas molecules or form ion species (unsuitable for ETD) through reaction with species present in the background gas.

Generation of reagent ions using a conventional chemical ionization (CI) technique has been disclosed in the prior art (see, e.g., the aforementioned Syka et al. paper as well as U.S. Pat. No. 7,456,397 by Hartmer et al.), and has been implemented in at least one commercially-available ion trap mass spectrometer. In such sources, reagent ions are formed by reaction of reagent vapor molecules with secondary electrons. CI sources typically employ an energized filament to produce a stream of electrons that preferentially ionizes secondary molecules. Reagent ions formed in the CI source may be directed through a dedicated set of ion optics, and introduced into a two-dimensional ion trap for reaction with analyte ions via an end of the trap opposite to the end through which the analyte ions are introduced, as described in Syka et al. Alternatively, analyte and reagent ions may be sequentially passed into a common aperture or end of an ion trap by an ion switching structure, as described in the Hartmer et al. patent.

Mass spectrometer configurations utilizing a CI reagent ion source have been utilized successfully for ETD experiments, but present a number of operational and design problems. The filaments in the CI source may fail in an unpredictable manner and need to be replaced frequently. Cleaning and maintenance of the CI source may require venting of the mass spectrometer and consequent downtime. Further, the need to provide dedicated guides or switching optics to direct ions from the CI source to the ion trap complicates instrument design and may interfere with the ability to incorporate additional components, e.g., other mass analyzers, into the ion path.

SUMMARY

Embodiments of the present invention provide a reagent ion source for a mass spectrometer having a reagent vapor source that supplies gas-phase reagent molecules to a reagent ionization volume maintained at low vacuum pressure. A voltage source applies a potential across electrodes disposed in the reagent ionization volume to produce an electrical discharge (e.g., a glow discharge) that ionizes the reagent vapor to generate reagent ions. The reagent ions flow through an outlet to a reduced-pressure chamber of the mass spectrometer, and are thereafter directed to an ion trap or other structure for reaction with oppositely charged analyte ions.

In specific implementations, the reagent may take the form of a polyaromatic hydrocarbon suitable for use as an ETD reagent. The reagent vapor may be generated by heating a quantity of the reagent substance in condensed-phase form and transported to the reagent ionization volume by entrainment in a carrier gas stream. The ionization volume may be divided by an apertured partition into a discharge region extending between the electrodes and an exit region located adjacent to the outlet of the ionization volume. The pressure within the reagent ionization volume (or portion thereof in which the discharge occurs) may be maintained between 0.5-10 Torr. The potential applied to the electrodes may be pulsed on and off to control the production of reagent ions. The reagent vapor source may include first and second evaporation chambers respectively containing a first reagent substance (e.g., an ETD reagent) and a second reagent substance (e.g., a proton transfer reaction (PTR) reagent. The reagent ion source constructed in accordance with embodiments of the present invention may be combined with an atmospheric-pressure analyte ionization source, such as an electrospray ionization source, which produces analyte ions of opposite polarity to the reagent ions. In this configuration, the analyte ions traverse under the influence of a pressure and/or electrical gradient and pass into the reduced-pressure chamber of the mass spectrometer. The reagent or analyte ions are selectively admitted and transported through downstream ion optics to the ion trap by adjusting the polarities and amplitudes of the DC offset voltages applied to the ion optics.

DESCRIPTION OF ILLUSTRATIVE EMBODIMENTS

Figure 1:
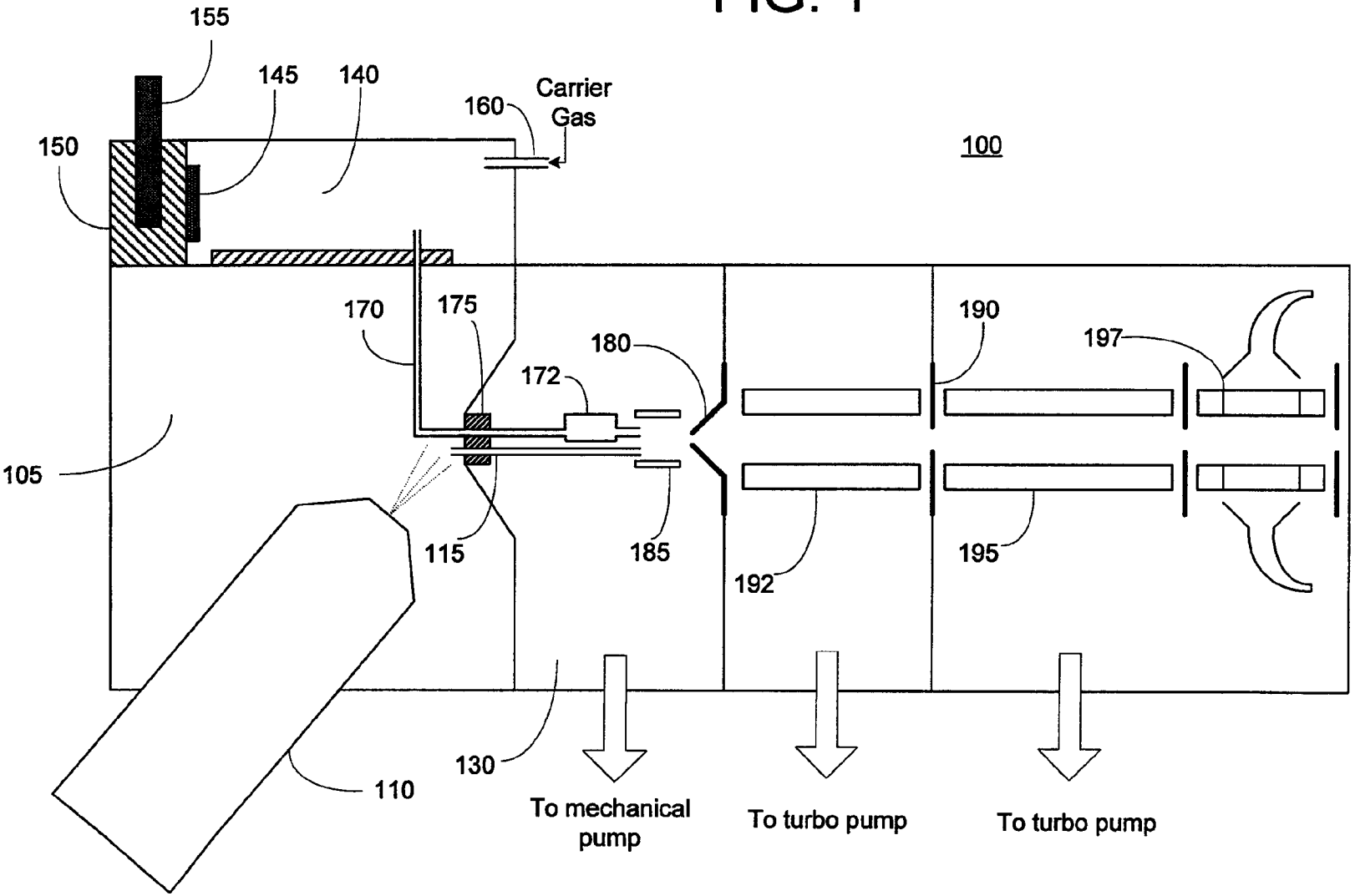
FIG. 1 is a symbolic diagram of an ion trap mass spectrometer incorporating a front-end reagent ion source, in accordance with an illustrative embodiment of the invention.

FIG. 1 schematically depicts a mass spectrometer 100 incorporating a front-end reagent ion source constructed according to an embodiment of the present invention. As used herein, the term "front-end" denotes that the ion source is configured to introduce reagent ions into a region located upstream in the analyte ion path relative to components of mass spectrometer 100 disposed in lower-pressure chambers (e.g., a mass analyzer), such that the analyte ions and reagent ions traverse a common path. Analyte ions (typically multiply-charged cations) are formed by electrospraying a sample solution into an analyte ionization chamber 105 via an electrospray probe 110. Analyte ionization chamber 105 will generally be maintained at or near atmospheric pressure. The analyte ions, together with background gas and partially desolvated droplets, flow into the inlet end of a conventional ion transfer tube 115 (which may take the form of a narrow-bore capillary tube) and traverse the length of the tube under the influence of a pressure gradient. Analyte ion transfer tube 115 is preferably held in good thermal contact with a heated block (not depicted). As is known in the art, heating of the ion/gas stream passing through analyte ion transfer tube 115 assists in the evaporation of residual solvent and increases the number of analyte ions available for measurement. The analyte ions emerge from the outlet end of analyte ion transfer tube 115, which opens to reduced-pressure chamber 130. As indicated by the arrow, chamber 130 is evacuated to a low vacuum pressure (typically within the range of 0.1-50 Torr, and more typically between 0.5 and 10 Torr) by a mechanical pump or equivalent.

To produce reagent vapor for production of the requisite reagent ions (having a polarity opposite to that of the analyte ions), a reagent evaporation chamber 140 is provided having located therein a volume of a reagent substance 145 (for example and without limitation, a polyaromatic such as fluoranthene for ETD reagent ions, or benzoic acid for proton transfer reaction (PTR) reagent ions) in condensed-phase (solid or liquid) form. Reagent substance 145 is placed in thermal contact with a block 150 heated by a cartridge heater 155. The reagent vapor pressure within chamber 140 is regulated by controlling the temperature (via adjusting power supplied to heater 155) of block 150. A flow of generally inert carrier gas (such as nitrogen, argon or helium) is introduced at a controlled rate through inlet 160 opening to the interior of chamber 140 to assist in the transport of reagent vapor molecules. The carrier gas also functions to continuously purge the interior of chamber 140 to prevent the influx of oxygen or other reactive gas species, which can react with and destroy ions formed from the reagent vapor.

While the interior volume of reagent evaporation chamber 140 will typically be held at or near atmospheric pressure, embodiments of the invention should not be construed as limited to atmospheric pressure operation. In certain implementations, it may be advantageous to maintain evaporation chamber 140 at a pressure substantially above or below atmospheric pressure. It is noted, however, that the pressure of reagent evaporation chamber 140 will need to be elevated relative to the pressure within reduced-pressure chamber 130 to establish a pressure gradient that results in the forward flow of reagent molecules through reagent transfer tube 170.

Molecules of reagent vapor entrained in the carrier gas enter an inlet end of reagent transfer tube 170 and traverse the length of the tube under the influence of a pressure gradient. Reagent transfer tube 170 may be a narrow-bore capillary tube fabricated from a suitable material, which extends between the interior of reagent evaporation chamber 140 and reagent ionization volume 172. Reagent transfer tube 170, or a portion thereof, may be heated to prevent condensation of reagent material on the inner surfaces of the tube walls.

Figure 2:
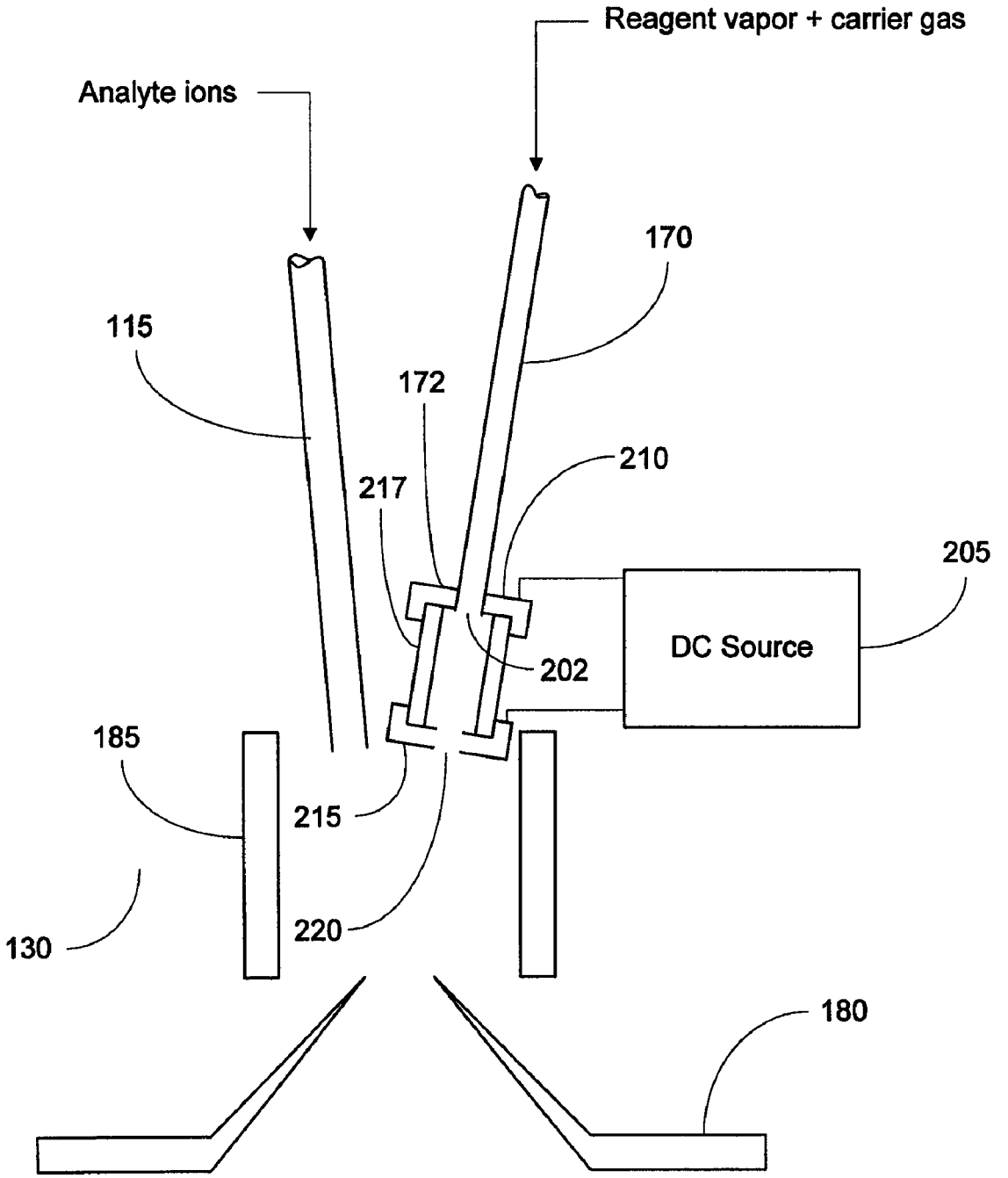
FIG. 2 is a symbolic diagram showing details of the reagent ionization volume of FIG. 1.

Referring to FIG. 2, the reagent vapor enters reagent ionization volume 172 through an inlet 202 thereof. Reagent ionization volume 172 is located within chamber 130 of mass spectrometer 100, and functions to ionize (either directly or via a process involving intermediates) at least a portion of the reagent vapor transported thereto in order to produce the desired reagent ions (e.g., fluoranthene anions). For this purpose, reagent ionization volume 172 is provided with electrodes 210 and 215, across which a potential is applied by a voltage source 205 to establish a controlled discharge, which will preferably take the form of a low-current (e.g., 1-100μamp) discharge such as a Townsend (dark) or glow discharge. As used herein, the term "reagent ionization volume" denotes a structure operable to effect ionization of the reagent vapor, and includes (without limitation) a structure having separated regions in which electrical discharge and ionization take place, per the embodiments depicted in FIGS. 3 and 7 and described below. Insulative sidewalls 217 extend between electrodes 210 and 215 and form with the electrodes a region that is generally closed to the exterior regions of chamber 130. Voltage source 205 will preferably include a current limiting circuitry to prevent transition of the low-current (e.g., glow) discharge to a high-current arc discharge. Ionization volume 172 communicates with the interior volume of chamber 130 via a short outlet section or aperture 220, and is thus maintained at a sub-atmospheric pressure. The actual pressure within reagent ionization volume 172 will be a function of the pressure maintained within chamber 130, the conductance of outlet section 220, and the flow rate of carrier gas/reagent vapor into ionization volume 172. Typically, the reagent ionization volume will be operated to maintain the region at which the electrical discharge occurs at a pressure of between 0.5-10 Torr, although certain implementations may utilize pressures as low as 0.1 Torr or as high as 50 Torr. It has been observed that operation of the controlled discharge at sub-atmospheric pressure promotes stability of the discharge and reduces the temporal variation in the number of reagent ions produced relative to an ionization volume that operates at atmospheric or near-atmospheric pressures.

In a variation of the FIG. 2 design, reagent ionization volume 172 may be adapted with a second inlet for introducing a flow of discharge gas into its interior region. The discharge gas may be of the same composition as the carrier gas (e.g., nitrogen, argon or helium), and the carrier gas and the discharge gas may be supplied from a common source via separately metered lines. This "split-flow" configuration enables independent control of the pressure within ionization volume 172 (which will depend on the combined discharge and carrier gas flow rates) and the flow rate of reagent vapor to ionization volume 172 (which will be governed by the vapor pressure within evaporation chamber evaporation chamber 140 and the carrier gas flow rate).

It should be recognized that the position and physical configuration of discharge chamber 172 may be optimized and/or adjusted in view of space constraints, ion flow path considerations, and other operational or design parameters. It is generally desirable to select an electrode gap (the distance between electrodes 210 and 215) that places the product of the gap and operating pressure at or close to the minimum of the Paschen breakdown curve in order to minimize the potential required to be applied by voltage source 205.

Reagent ions are produced within ionization volume 172 by the direct or indirect interaction of reagent vapor molecules with electrons produced by the electrical discharge. The reagent ions exit ionization volume 172 through outlet section 220 and flow into chamber 130 under the influence of a pressure and/or electrical field gradient. The reagent ions may then be focused by tube lens 185 before passing into the succeeding chamber of mass spectrometer through an aperture in skimmer lens 180. It will be recognized that the analyte ions and reagent ions traverse a common path through the various ion transport optics (tube lens 185, skimmer lens 180, plate lens 190, and RF multipole ion guides 192 and 195) between chamber 130 and the reaction region, which may take the form of a two-dimensional quadrupole ion trap mass analyzer 197, as depicted in FIG. 1.

The analyte and reagent ion sources may be operated to provide a continuous supply of analyte and reagent ions into chamber 130. For ETD, the analyte and reagent ions are injected sequentially into a reaction region (e.g., ion trap 197). Selection of the ions to be delivered to ion trap 197 (i.e., the analyte or reagent ions) may be accomplished by applying DC voltages of suitable magnitude and polarity to the various ion transport optics, such that only the analyte ions are delivered to ion trap 197 at a first set of applied DC voltages, and only the reagent ions are delivered at a second set of DC voltages. Other implementations of the invention may utilize a dedicated switching structure, such as the split-lens switch disclosed in U.S. Pat. No. 7,456,397. by Hartmer et al. In certain implementations, one of the RF multipole ion guides of the ion transport optics (which may be constructed from a set of rod electrodes having square or rectangular cross-sections) may be made mass selective by adding a resolving DC component to the applied RF voltages to filter ions outside of a specified range of mass-to-charge ratios (m/z's) to prevent the entry of undesirable ion species during the reagent ion injection period. Alternatively, isolation waveforms may be applied to the ion guide electrodes to resonantly eject the undesirable ion species.

A notable feature of the foregoing embodiment is that the reagent and analyte ion flows are maintained separate and unmixed until they arrive at reduced-pressure chamber 130. The undesirable reaction of the analyte ions with background gas molecules and reagent ions within chamber 130 may be alleviated by positioning skimmer lens 180 close to the outlets of the ion transfer tube 115 and reagent ionization volume 172, such that the number of collisions that the analyte ions undergo within chamber 130 is minimized.

In a preferred mode of operation of mass spectrometer 100, reagent ions are produced intermittently rather than continuously. It will be understood that reagent ions need only be generated during a small fraction of the total analysis cycle time, e.g., when injecting ETD reagent ions into ion trap 197 for subsequent reaction with analyte ions; at other times, the reagent ions are not needed and are diverted from the ion path and destroyed. It may therefore be beneficial to pulse reagent ion production on and off such that the reagent ions are generated on an "as needed basis" in order to reduce wear on components of the reagent ion source (for example, electrodes 210 and 215) and to reduce the rate of deposition of material on skimmer lens 180 and other components within chamber 130 (and thereby alleviating cleaning and maintenance requirements). Pulsing reagent ion production may be effected by switching on and off the potential applied to electrodes 210 and 215 to selectively establish the discharge, or by switching on and off (e.g., via a pulse valve) the carrier gas flow to evaporation chamber 140.

Figure 3:
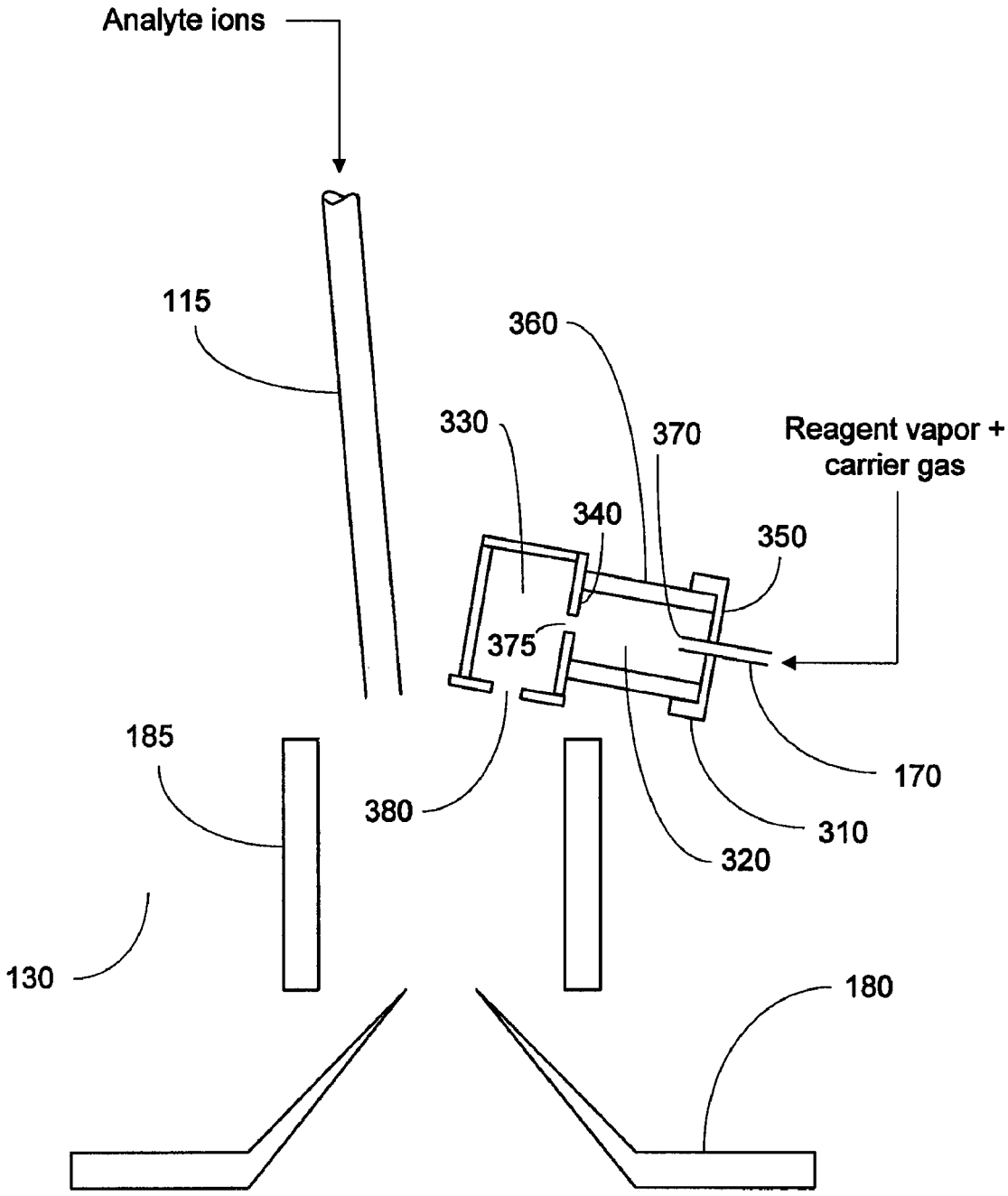
FIG. 3 is a symbolic diagram showing a reagent ionization volume constructed according to a different embodiment of the invention, having a discharge region oriented transversely to an ionization region.

FIG. 3 depicts an alternative embodiment of the front-end analyte/reagent ion source, in which reagent ionization volume 310 is divided into a discharge region 320 and an ionization region 330 by apertured electrode 340. Discharge region 320 is defined by electrodes 340 and 350 and insulative sidewall 360. A voltage source (not depicted) applies a suitable potential across electrodes 340 and 350 to generate an electrical (e.g., glow) discharge. Carrier gas and entrained reagent vapor enter discharge region 320 via inlet 370, and flow thereafter through aperture 375 to ionization region 330, in which ionization of the reagent vapor is believed to primarily occur. Again, ionization may result from a direct or indirect (mediated) interaction with electrons produced in the electrical discharge. While reagent ionization volume 310 is constructed such that the axis defined between electrodes 340 and 350 within discharge region 320 is transverse to the flow axis within ionization region 330, other implementations of the divided ionization volume design may be implanted in a co-axial geometry, i.e., where the electrode-defined axis within the discharge region is directed co-linear or parallel to the flow axis within the ionization region. The reagent ions then pass from ionization region 330 to chamber 130 via outlet 380. By placing a conductance-limited aperture 375 between discharge region 320 and ionization region 330, the pressure within discharge region 320 may be controlled independently of the pressure within chamber 130 without requiring an excessively small outlet 320 that could adversely affect the efficiency of reagent transport.

Figure 7:
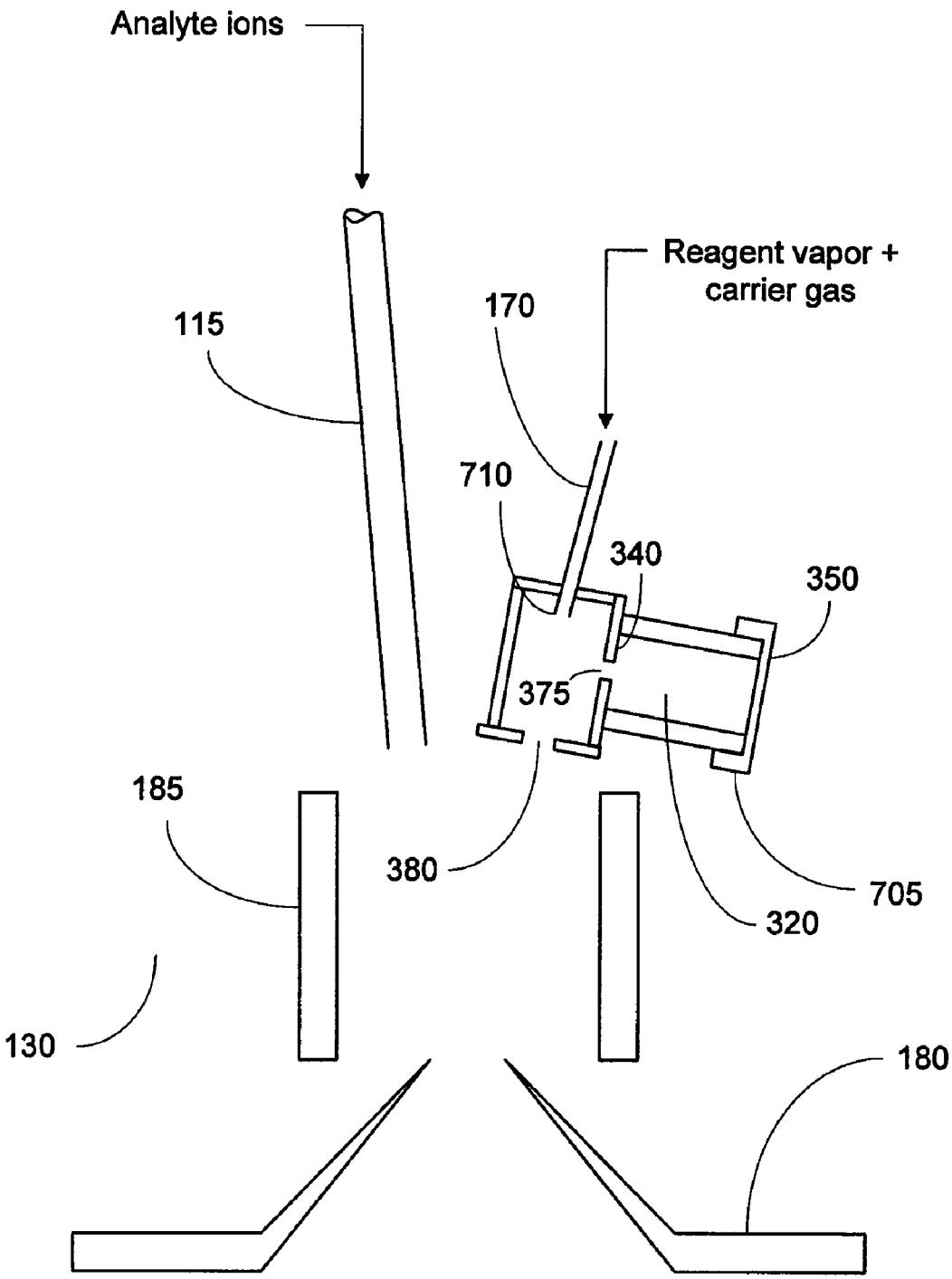
FIG. 7 is a symbolic diagram showing a reagent ionization volume constructed in accordance with a variation of the FIG. 3 design, wherein the reagent vapor and carrier gas are introduced along an axis transverse to the discharge region.

FIG. 7 depicts a variation on the FIG. 3 reagent ionization volume design, wherein the carrier gas and entrained reagent vapor are introduced into reagent ionization volume 705 via an inlet 710 having a flow axis that is transverse to the primary axis (defined between electrodes 340 and 350) of discharge region 320 and parallel to the flow axis within ionization region 330. Ionization of reagent vapor molecules occurs in ionization region 330 by direct or indirect interaction with electrons, produced within discharge region 320, and entering ionization region 330 through aperture 375. The resultant reagent ions are then transported into chamber 130 through outlet 380.

Figure 4:
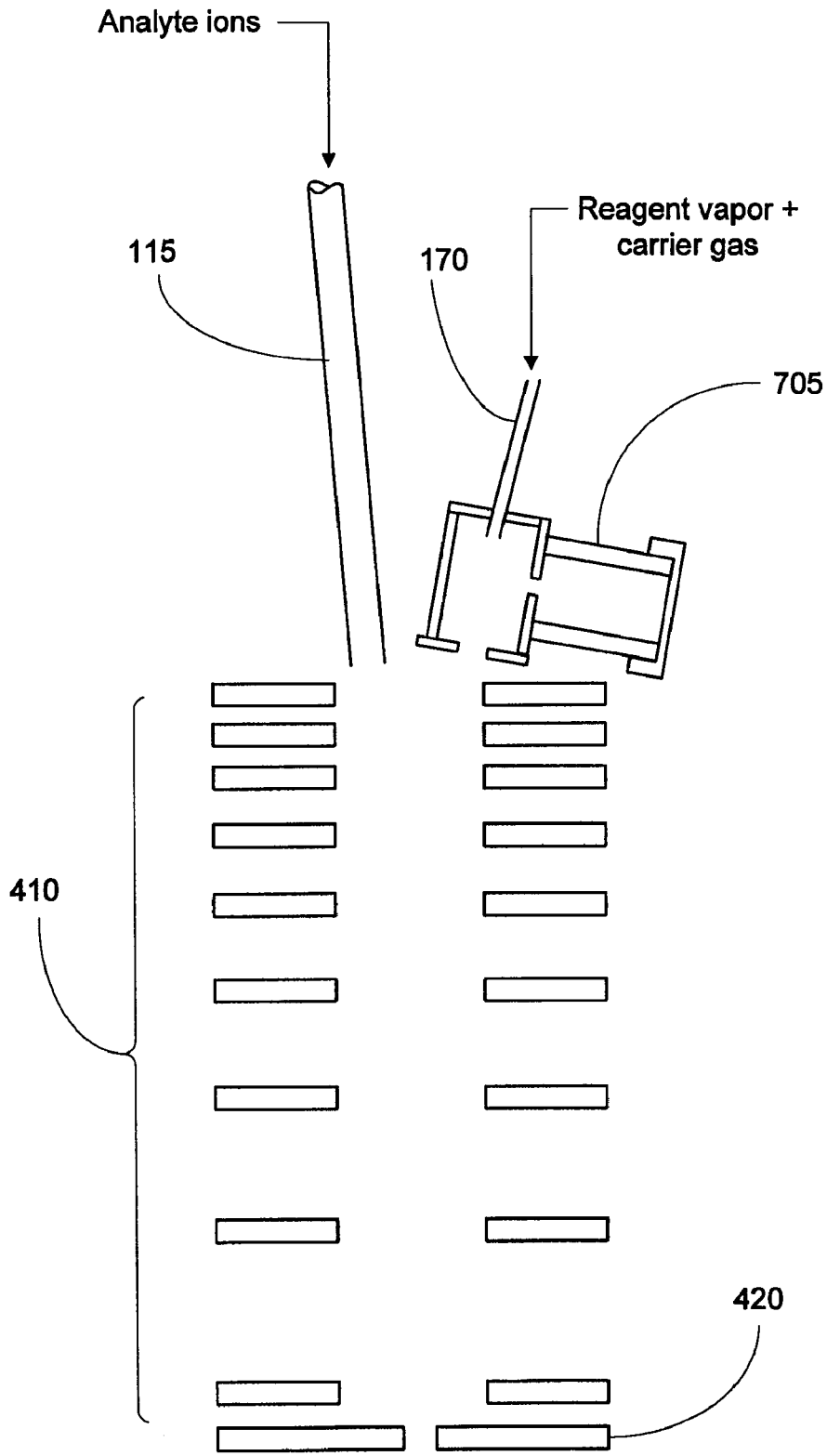
FIG. 4 is a symbolic diagram depicting an alternative implementation in which the reagent ionization volume is located adjacent to the entrance to an RF ion transport optic constructed from a plurality of spaced ring electrodes (hereinafter referred to as an "S-lens")

While embodiments of the invention have been described and depicted in connection with a conventional tube lens/skimmer lens structure, these embodiments may be readily adapted for use with other ion optical arrangements. FIG. 4 depicts one such alternative arrangement, in which the analyte and reagent ions (from reagent ionization volume 705) are directed through an S-lens 410 rather than into the tube lens and skimmer shown in FIGS. 1 and 2. S-lens 410, the design and operation of which are discussed in detail in U.S. Patent Application Publication No. US2009/0045062A1. by Senko et al. (incorporated herein by reference), is constructed from a set of aligned ring electrodes having progressively increasing inter-electrode spacing in the direction of ion travel. RF voltages are applied to the ring electrodes to radially confine the ions and focus them to a flow centerline. It has been found that S-lens 410 provides more efficient transport of analyte ions to downstream regions relative to a conventional skimmer structure, thereby improving instrument sensitivity. It has been observed, however, that under certain conditions transport of reagent ions (e.g., fluoranthene ions) through the full length of S-lens 410 may result in the destruction of excessive numbers of the reagent ions. To avoid this undesirable result, reagent ionization volume 172 may be moved such that the reagent ions are introduced in a gap between electrodes of the S-lens or between the final ring electrode and extraction lens 420, so that the reagent ions do not traverse the entire length of S-lens 410.

Figure 5:
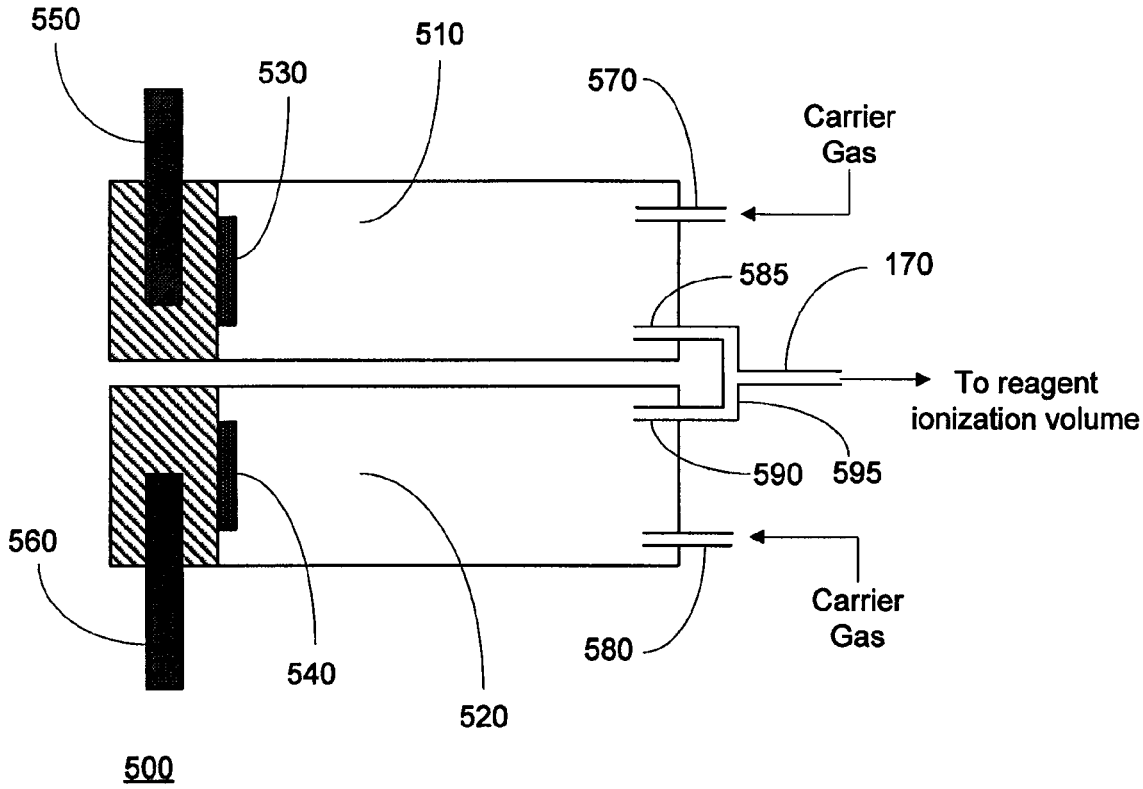
FIG. 5 is a symbolic diagram of a reagent vapor source configured to supply two different reagents to the reagent ionization volume.

In certain types of mass spectrometric analysis, it may be necessary to supply (sequentially or concurrently) two or more distinct reagent ion species to the ion trap or other reaction region of the mass spectrometer. For example, Coon et al. ("Protein Identification Using Sequential Ion/Ion Reactions and Tandem Mass Spectrometry", *Proc. Nat. Acad. Sci.*, Vol. 102, No. 27, pp. 9463-9468(2005)) describes experiments in which ETD, produced by reaction of analyte peptide ions with fluoranthene ions, is followed by proton transfer reaction (PTR) to reduce the charge states of the ETD product ions, which occurs by reaction with deprotonated benzoic acid ions. FIG. 5 depicts a reagent vapor source 500 adapted to supply two different reagents (e.g., ETD and PTR reagents) to reagent ionization volume 172. Reagent vapor source 500 includes first and second evaporation chambers 510 and 520 that are separate and divide from each other. First evaporation chamber 510 contains a quantity of a first reagent substance 530 (e.g., fluoranthene) in condensed phase form, and second evaporation chamber similarly contains a second reagent substance 540 (e.g., benzoic acid) in condensed-phase form. First and second evaporation chambers 510 and 520 are provided with independently controllable heaters 550 and 560 to vaporize the corresponding reagents. Separate carrier gas flows are directed into first and second evaporation chambers 510 and 520 through inlets 570 and 580. The carrier gas and entrained reagent vapor exit first and second evaporation chambers 510 and 520 via outlets 585 and 590. The gas outlets are coupled to a proximal end of reagent transfer tube 170 by tee 595. The reagents, or a selected one thereof, are transported through reagent transfer tube 170 to reagent ionization volume 172.

If the reagents are to be supplied to the reaction region in a sequential manner, selection of the desired reagent ion may be effected by operating at least one of the ion transport optics in a mass-selective manner, to selectively transmit the desired ion species while excluding the undesired ion species. As discussed above, this may be accomplished by applying a filtering DC component to an RF ion guide, or by employing an isolation waveform. Alternatively, a flow switch may be provided to allow transport of the selected reagent to ion transfer tube 170 while inhibiting the flow of the non-selected reagent. For example, selection of a reagent may be achieved by turning on the flow of its carrier gas and turning off the flow of the carrier gas corresponding to the non-selected reagent, such that only the selected reagent is delivered to tee 595. According to another alternative, selection of a reagent may be effected through use of an appropriate valve structure in outlets 585 and 590 or tee 595 to controllably obstruct or divert the flow of carrier gas containing the non-selected reagent to prevent its entry into reagent transfer tube 170.

Although reagent vapor source 150 is configured to provide two reagents to the reagent ionization volume, those skilled in the art will recognize that its design may be easily modified to provide three or more reagents, if required by the mass spectrometric analysis technique to be utilized.

Figure 6:
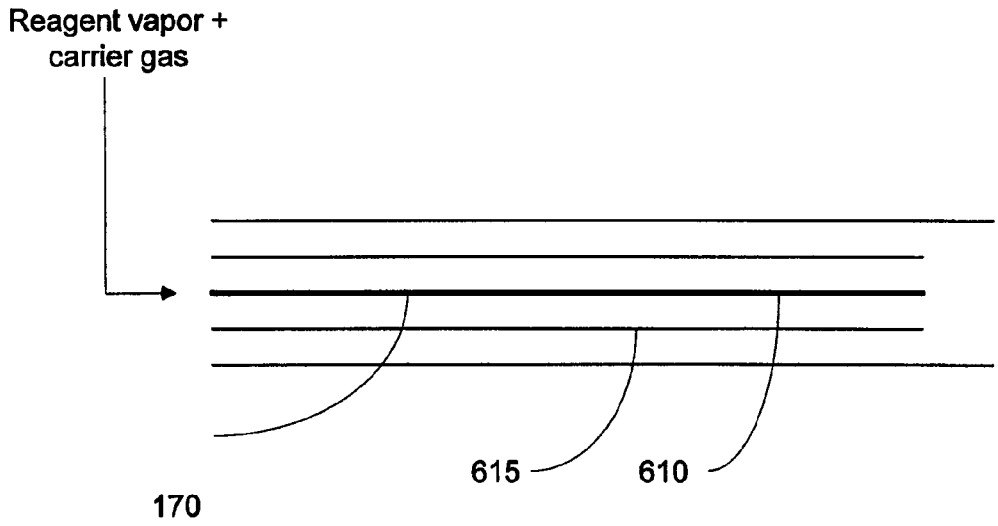
FIG. 6 is a symbolic diagram depicting another embodiment of the invention, wherein the reagent ionization volume is located at the end portion of an ion transfer tube.

FIG. 6 depicts in fragmentary view an alternative embodiment of the invention, wherein a controlled discharge is generated within reagent transfer tube 170 proximate to the outlet end thereof in place of a separate ionization volume. A conductive wire 610 is placed within the interior of reagent transfer tube 170 (which is itself fabricated from a conductive material). An insulator 615, which may take the form of a fused silica tube, is radially interposed between wire 610 and the inner surface of reagent transfer tube 170. Application of a suitable potential across wire 610 and reagent transfer tube 170 causes an electrical discharge (e.g., a glow discharge) to be produced at a region near the outlet end that is maintained at a sub-atmospheric pressure close to the pressure within chamber 130 (preferably between 0.5 and 10 Torr). The location and stability of the discharge may be optimized by appropriately tuning design and operational parameters, including (without limitation) the sizes and relative positioning of wire 610, insulator 615 and reagent transfer tube 170, the voltage applied to wire 610, and the geometry (e.g., flared or rolled) of the outlet end of transfer tube 170. The location and stability of the discharge will also be affected by the gas pressure at the outlet end of reagent transfer tube 170.

It should be further recognized that the specific implementation depicted and described herein, i.e., where the reagent ion source takes the form of an ETD reagent ion source supplying ions to an analytical two-dimensional ion trap, are intended to be illustrative rather than limiting. A reagent ion source constructed in accordance with the invention may be beneficially utilized for supplying reagent ions of any suitable type and character to one or more reaction regions, which will not necessarily include a trapping structure.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A reagent ion source for a mass spectrometer, comprising:

a reagent vapor source for supplying reagent vapor to a reagent ionization volume;

the reagent ionization volume being located within a chamber of the mass spectrometer and having, during operation of the mass spectrometer, an interior region maintained at a low vacuum pressure;

a set of electrodes disposed within the reagent ionization volume;

a voltage source for controllably applying a discharge potential across the set of electrodes to generate an electrical discharge that ionizes the reagent vapor to produce reagent ions;

a reagent ion outlet extending from the interior region of the reagent ionization volume to the chamber of the mass spectrometer; and at least one ion optical element for transporting the reagent ions to a succeeding chamber of the mass spectrometer, the at least one ion optical element being positioned along an analyte ion path;

wherein the reagent ionization volume includes a discharge region extending between the set of electrodes, an ionization region communicating with the reagent ion outlet, and a partition dividing the discharge region from the ionization region, the partition having a conductance limited aperture formed therein such that the ionization region and the discharge region are held at substantially different pressures during device operation.

2. The reagent ion source of claim 1, wherein the reagent vapor source includes an evaporation chamber for holding a quantity of reagent substance in condensed-phase form, and a heater for controlling the temperature of the reagent substance to regulate the production of reagent vapor.

3. The reagent ion source of claim 1, wherein the reagent vapor source further includes a first inlet for receiving a flow of carrier gas, the carrier gas assisting to transport the reagent vapor to the reagent ionization volume.

4. The reagent ion source of claim 1, wherein the reagent substance is a polyaromatic hydrocarbon.

5. The reagent ion source of claim 1, wherein an axis defined between the set of electrodes in the discharge region is generally transverse to a primary flow axis in the ionization region.

6. The reagent ion source of claim 1, wherein the location within the interior region in which the electrical discharge occurs is maintained at a pressure between 0.5 and 10 Torr.

7. The reagent ion source of claim 1, wherein the voltage source pulses the discharge potential to selectively switch on or off production of reagent ions.

8. The reagent ion source of claim 1, wherein the reagent vapor source comprises:

a first evaporation chamber for holding a quantity of a first reagent substance in condensed-phase form; and a second evaporation chamber for holding a quantity of a second reagent substance in condensed-phase form.

9. The reagent ion source of claim 8, wherein the at least one ion optical element is configured to selectively transmit a first reagent ion species formed from the first reagent substance or a second reagent ion species formed from the second reagent substance.

10. The reagent ion source of claim 8, further comprising a flow switch for selectively directing vapor from the first or second reagent substance to the reagent ionization volume.

11. The reagent ion source of claim 1, wherein a potential applied to the at least one ion optical element is varied to selectively transmit the reagent ions or the analyte ions.

12. The reagent ion source of claim 1, wherein the electrical discharge is a low-current electrical discharge.

13. The reagent ion source of claim 12, wherein the low-current electrical discharge is a glow discharge.

14. Apparatus for supplying analyte ions and reagent ions in a mass spectrometer, comprising:

an analyte ionization chamber maintained, during operation of the mass spectrometer, at a generally atmospheric pressure;

a first passageway for transporting analyte ions formed in the analyte ionization chamber to a first chamber maintained at reduced pressure relative to the analyte ionization chamber;

a reagent vapor source for supplying reagent vapor to a reagent ionization volume, the reagent ionization volume having, during operation of the mass spectrometer, an interior region maintained at a low vacuum pressure;

a set of electrodes disposed within the reagent ionization volume;

a voltage source for controllably applying a discharge potential across the set of electrodes to generate an electrical discharge that ionizes the reagent vapor to produce reagent ions;

a reagent ion outlet extending from the interior region of the reagent ionization volume to the first chamber; and at least one ion optical element for transporting both the analyte ions and the reagent ions from the first chamber to a second chamber having a pressure lower than the first chamber;

wherein the reagent ionization volume includes a discharge region extending between the set of electrodes, an ionization region communicating with the reagent ion outlet, and a partition dividing the discharge region from the ionization region, the partition having a conductance limited aperture formed therein such that the ionization region and the discharge region are held at substantially different pressures during device operation.

15. The apparatus of claim 14, wherein the reagent vapor source includes an evaporation chamber for holding a quantity of reagent substance in condensed-phase form, and a heater for controlling the temperature of the reagent substance to regulate the production of reagent vapor.

16. The apparatus of claim 14, wherein the reagent vapor source further includes a first inlet for receiving a flow of carrier gas, the carrier gas assisting to transport the reagent vapor to the reagent ionization volume.

17. The apparatus of claim 14, wherein the reagent substance is a polyaromatic hydrocarbon.

18. The apparatus of claim 14, wherein an axis extending between the set of electrodes in the discharge region is generally transverse to a primary gas flow axis in the ionization region.

19. The apparatus of claim 14, wherein the location within the interior region in which the electrical discharge occurs is maintained at a pressure between 0.5 and 10 Ton.

20. The apparatus of claim 14, wherein the voltage source pulses the discharge potential to selectively switch on or off production of reagent ions.

21. The apparatus of claim 14, wherein the reagent vapor source comprises:

a first evaporation chamber for holding a quantity of a first reagent substance in condensed-phase form; and a second evaporation chamber for holding a quantity of a second reagent substance in condensed-phase form.

22. The apparatus of claim 21, wherein the at least one ion optical element is configured to selectively transmit a first reagent ion species formed from the first reagent substance or a second reagent ion species formed from the second reagent substance.

23. The apparatus of claim 21, further comprising a flow switch for selectively directing vapor from the first or second reagent substance to the reagent ionization volume.

24. The apparatus of claim 14, further comprising an electrospray probe for introducing charged droplets containing the analyte into the analyte ionization chamber.

25. The apparatus of claim 14, wherein a potential applied to the ion optic element is varied to selectively transmit the reagent or analyte ions.

26. The apparatus of claim 14, wherein the at least one ion optical element comprises a plurality of spaced ring electrodes to which RF voltages are applied.

27. The apparatus of claim 14, wherein the at least one ion optical element comprises a skimmer.

28. The apparatus of claim 14, wherein the electrical discharge is a low-current electrical discharge.

29. The apparatus of claim 28, wherein the low-current electrical discharge is a glow discharge.

* * * * *

UNITED STATES PATENT AND TRADEMARK OFFICE

CERTIFICATE OF CORRECTION

PATENT NO. : 8,119,984 B2
APPLICATION NO. : 12/473570
DATED : February 21, 2012
INVENTOR(S) : Shabanowitz et al.

It is certified that error appears in the above-identified patent and that said Letters Patent is hereby corrected as shown below:

In the specification
In column 1, line 12, after "reference.", insert --¶STATEMENT OF GOVERNMENT INTEREST
This invention was made with government support under AI033993 and GM037537 awarded by the National Institutes of Health. The government has certain rights in the invention.--, therefor Signed and Sealed this
Twenty-sixth Day of April, 2016

Michelle K. Lee

Michelle K. Lee
*Director of the United States Patent and Trademark Office*